United States Patent [19]

Kikuchi et al.

[11] Patent Number: 4,690,577

[45] Date of Patent: Sep. 1, 1987

[54] PRINTING MEDIUM DETECTING MECHANISM OF PRINTER

[75] Inventors: Hiroshi Kikuchi; Shyoichi Watanabe; Yukio Ohta, all of Tokyo, Japan

[73] Assignee: Oki Electric Industry Co., Ltd., Tokyo, Japan

[21] Appl. No.: 791,696

[22] Filed: Oct. 25, 1985

[30] Foreign Application Priority Data

Oct. 25, 1984 [JP] Japan ..... 59-222990

[51] Int. Cl.[4] ..... B41J 29/46

[52] U.S. Cl. ..... 400/708; 400/642; 400/662; 400/706; 400/711

[58] Field of Search ..... 400/605, 648, 662, 679, 400/707.1, 706, 708, 708.1, 642, 645.2, 703, 711

[56] References Cited

U.S. PATENT DOCUMENTS

| | | | |
|---|---|---|---|
| 1,053,926 | 2/1913 | Neidig | 400/707.1 |
| 1,838,881 | 12/1931 | Taylor | 400/708 |
| 2,599,085 | 6/1952 | Bader | 400/707.1 |
| 4,111,565 | 9/1978 | Jagger | 400/708 |
| 4,141,660 | 2/1979 | Bommersheim et al. | 400/708 |

FOREIGN PATENT DOCUMENTS

| | | | |
|---|---|---|---|
| 2716396 | 10/1978 | Fed. Rep. of Germany | 400/605 |

OTHER PUBLICATIONS

J. H. Dodge et al., "Two-Point Paper Path Condition Switch"; *IBM Technical Disclosure Bulletin*; vol. 22, No. 3, pp. 914—914; Aug. 1979.

R. H. Hams et al., "Journal Roll Take-up Compensation Method & Apparatus"; IBM Tech. Disc. Bull.; vol. 26, No. 6, pp. 2893-2895; Nov. 1983.

*Primary Examiner*—Charles A. Pearson
*Assistant Examiner*—David A. Wiecking
*Attorney, Agent, or Firm*—Wenderoth, Lind & Ponack

[57] ABSTRACT

A printing medium detecting mechanism of a printer having a plurality of printing medium traveling paths includes a detecting groove provided in a circumferential portion of a platen other than a printing region thereof, a first printing medium detecting lever disposed on one of the plurality of the traveling paths to freely fit in the detecting lever, and a medium detecting sensor provided on a printer control circuit board. The printing medium detecting mechanism further includes a second printing medium detecting lever provided on any other medium traveling path of the plurality of the medium traveling paths. The first printing medium detecting lever is adapted to be interlocked with the second printing medium detecting lever, thereby enabling to provide a simplified printing medium detecting mechanism.

10 Claims, 4 Drawing Figures

PRINTING MEDIUM DETECTING MECHANISM OF PRINTER

BACKGROUND OF THE INVENTION

1. Field of the Invention

The present invention relates to a printing medium detecting mechanism of a printer.

2. Description of the Prior Art

There is generally known heretofore, as a detecting sensor of a continuous printing medium detecting mechanism in a printer, a mechanism comprising a microswitch, a Hall device, a photointerrupter, a lead switch, and a detecting lever.

A printing medium is generally inserted from the rear of a platen, wound around the platen from the lower part thereof, and wound in front of a printing head. To so wind the printing medium around the platen, a paper chute is provided for guiding the printing medium, serving as a traveling path for a printing medium detecting mechanism provided therein.

By contrast, a printer of a certain kind has a traveling path other than that described above. This traveling path is provided such that the printing medium is inserted from the bottom of the printer, and fed through the front thereof toward a printing head. For that, a paper guide is provided below the platen. The other traveling path described above is formed by this paper guide. The other printing medium detecting mehanism is provided also in the other traveling path described above.

A printing medium detecting mechansim in a printer having a plurality of printing medium traveling paths as described above requires a plurality of medium detecting mechanisms and detecting circuits of the same kind. The printing medium detecting mechanism has drawbacks of allowing wirings thereof to connectors to be increased and a plurality of structures and assembling processes to be needed.

SUMMARY OF THE INVENTION

In view of the drawbacks with the conventional printing medium detecting mechanism, it is an object of the present invention to provide an improved printing medium detecting mechanism of a printer.

Another object of the present invention is to provide an improved printing medium detecting mechanism in a printer including a plurality of printing medium traveling paths.

Still another object of the present invention is to provide printing medium detecting mechanisms and detecting circuits minimized in the numbers thereof and simplified in the structures thereof in a printer including a plurality of printing medium traveling paths.

A still further object of the present invention is to provide a printing medium detecting mechanism limited in wirings thereof to a connector to the minimum and facilitated in assembling thereof.

According to the present invention, a first printing medium traveling path can serve to permit a first printing medium detecting lever to pivot due to the passage of a printing medium to operate a medium detecting sensor provided on a printer substrate, whereby the sensor detects the presence of the printing medium, while a second printing medium traveling path serves to permit the medium detecting sensor to be operated for detecting the presence of the printing medium with the first printing medium detecting lever by pivotal movement of a second printing medium detecting lever contacting the first lever by a cam.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
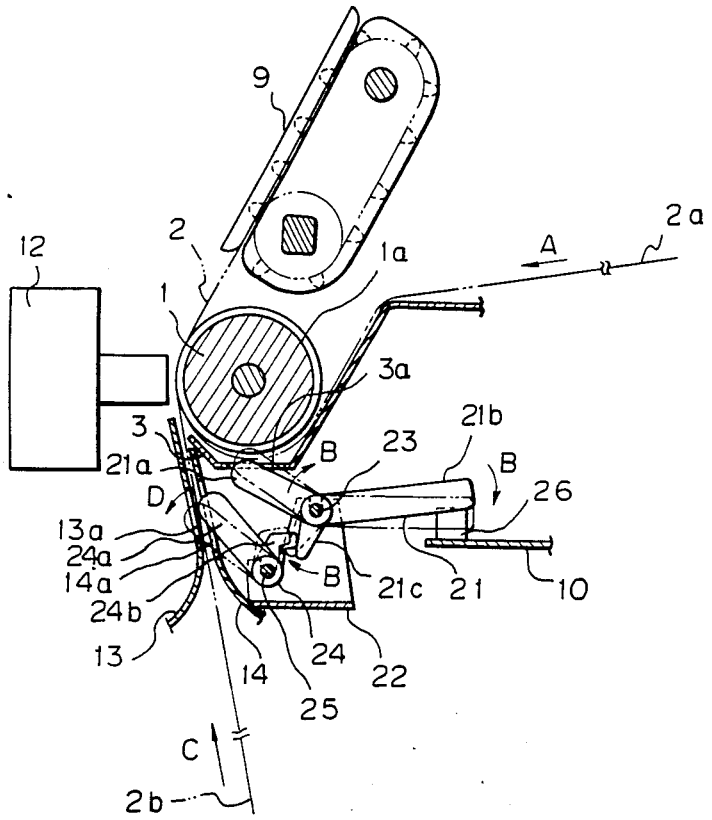
FIG. 1 is a side sectional view illustrating a first embodiment of a printing medium detecting mechanism of a printer acording to the present invention.
Figure 2:
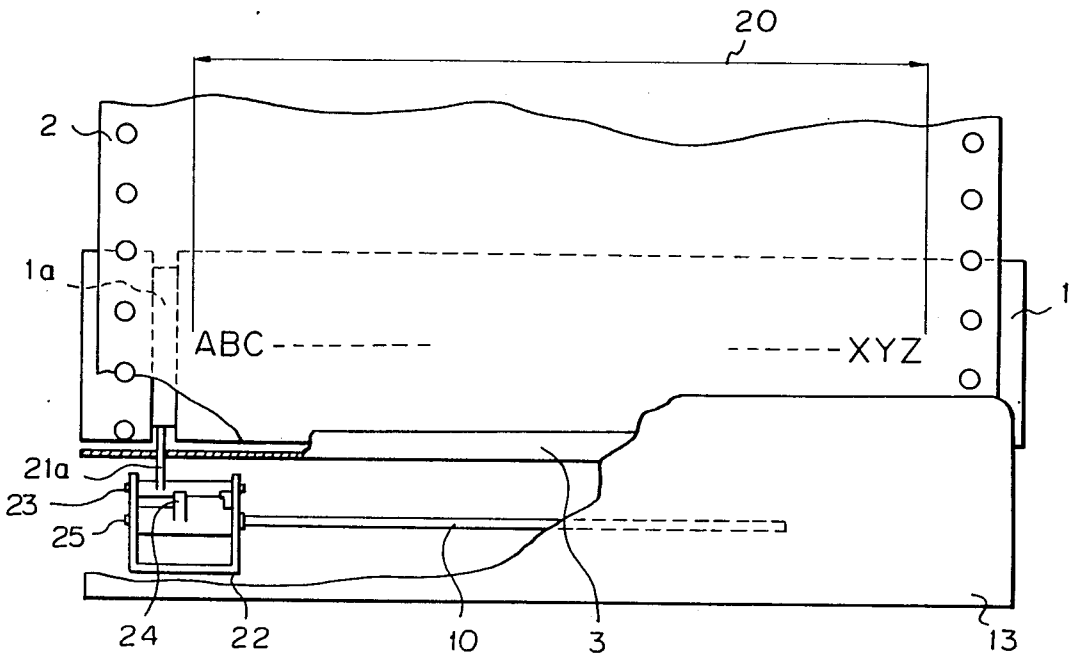
FIG. 2 is a front view illustrating the same embodiment as that in FIG. 1.
Figure 3:
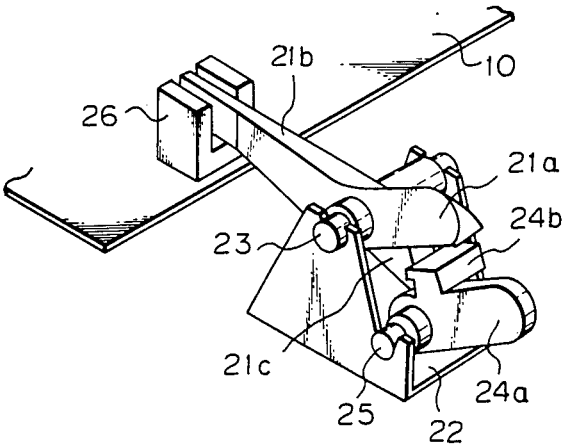
FIG. 3 is a perspective view illustrating in detail the detecting mechanism of FIGS. 1 and 2.

FIGS. 1 through 3 show a first embodiment of a printing medium detecting mechanism of a printer according to the present invention.

The printing medium detecting mechanism of a printer includes a platen 1 having a detecting groove 1*a* provided in a circumferential portion thereof other than a printing region 20 of the platen, a printing medium 2 wound around the platen 1 and having final ends 2*a*, 2*b* each for their insertions into the printer in the directions of arrows A and C, a horizontally extending paper chute 3 below the platen 1 for guiding the printing medium 2 to provide a travelling path of the medium and having a slit 3*a* provided therein for allowing the tip of a printing medium detecting lever to pass through the chute. The mechanism further includes a pin tractor unit 9 which may be separated from the platen 1 for feeding the printing medium 2, a printer control circuit board 10 provided on a frame of a printer body (not shown) for supporting a medium detecting sensor 26 disposed thereon, and a printing head 12 of the printer. Designated at 13, 14 are generally vertically extending front and rear paper guides supported on a frame of the printer body (not shown) for guiding the printing medium 2 coming from the lower part in the figures, both guides having slits 13*a*, 14*a* for allowing a bottom medium detecting lever 24 to pass therethrough.

Designated at 21 is a printing medium detecting lever supported on a support bracket 22, whose tip end 21*a* is freely fitted in the detection groove 1*a* and whose weight is distributed such that a rear end 21*b* of the printing medium detecting lever is slightly heavier than the tip end 21*a* with respect to support point 23 of rotation so as to bias the tip end 21*a* toward the detection groove 1*a*.

Designated at 24 is a bottom medium detecting lever is supported on the support bracket 22, whose weight is distributed such that the tip end 24*a* of the bottom medium detecting lever is slightly heavier than an opposite end thereof with respect to a support point 25 of rotation so as to bias the tip end 24*a* in a direction through the gap between guides 13 and 14 into the slit 14*a*.

Designated at 26 is a medium detecting sensor such as a photointerrupter directly disposed on the printer control base plate 10, and designated at 21*c* is a projection part provided on a part of the printing medium detecting lever 21 and adapted to form a cam together with a projection part 24*b* of the bottom medium detecting lever. Both the projection parts are disposed to contact each other.

Operation of the embodiment with the arrangement described above will be discribed below.

First, with the printing medium 2 inserted from a direction of an arrow A in the figure, the tip end 21*a* of the printing medium detecting lever in contact with the bottom surface of the detecting froove 1*a* in the platen 1 rises to the surface of the platen 1 due to reigidity of the printing medium 2, while the rear end 21*b* thereof is separated from the medium detecting sensor 26 and held in a state shown in FIG. 1, thus allowing the printer to be ready for opertion.

Then, when the printing medium 2 is fed by the pin tractor unit 9 and the final end 2*a* of the printing medium 2 passes through the tip end 21*a* of the printing medium detecting lever, the printing medium detecting lever 21 is rotated in a direction of an arrow B of FIG. 1 around the support point 23 of rotation, and the tip end 21*a* of the printing medium detecting lever is brough into contact with the bottom surface of the detecting groove 1*a* of the platen 1 passing through the slit 3*a*. With this, the rear end 21*b* of the printing medium detecting lever goes across the medium detecting sensor 26 mounted on the printer control circuit board 10, whereby the printer immediately stops printing operation thereof.

In addition, in case of insertion of the printing medium 2 from a direction of an arrow C of FIG. 1, with the tip end 24*a* of the bottom medium detecting lever rotated around the rotation support point 25 of rotation, the projection part 24*b* pushes the projection part 21*c* of the printing medium detecting lever is separated from the medium detecting sensor 26 to be kept in a state shown in FIG. 1, thereby allowing the printer to be ready for printing operation.

Successively, when the final end 2*b* of the printing medium 2 passes through the tip end 24*a* of the bottom medium detecting lever, the bottom medium detecting lever 24 is rotated in a direction of an arrow D of FIG. 1 around the rotation support point 25 and passes through the slits 13*a*, 14*a*. The rear end 21*b* of the medium detecting lever traverses the medium detecting sensor 26, whereby the printer is immediately stopped in printing operation thereof.

Figure 4:
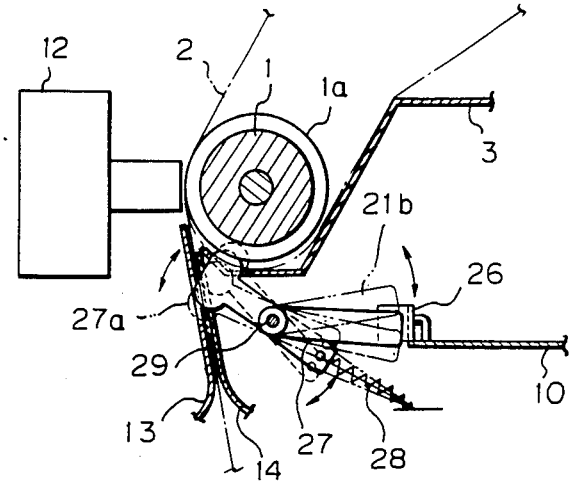
FIG. 4 is a side sectional view illustrating a second embodiment of a printing medium detecting mechanism of a printer according to the present invention.

FIG. 4 is a second embodiment of a printing medium detecting mechanism of a printer according to the present invention. Only the different parts from the first embodiment will be described. Designated at 27 is a printing medium detecting lever, which has a printing medium detecting lever tip end 27*a*, and designated at 28 is a reset spring fixed at opposite ends to lever 27 and a stationary portion of the printer for serving to urge the printing medium detecting lever 27 always toward a prescribed equilibrium postion in which rear end 21*b* crosses the sensor 26. This position is located between respective positions shown in phantom line in FIG. 4 in which tip end 27*a* is obstructed by the printing medium 2 to pivot the rear end above or below sensor 26 depending on the location of printing medium 2 along chute 3 or between guides 13 and 14. Here, the printing medium detecting lever 21 and the bottom medium detecting lever 24, both shown in the first embodiment, are replaced by the present one printing medium detecting lever 27, which is rotatable around a support point 29 of rotation in a direction of an arrow shown in FIG. 4. The printing medium 2 can be detected by the one printing medium detecting lever 27 regardless of a traveling path of the printing medium 1.

Although certain preferred embodiments have been shown and described, it should be understood that many changes and modifications may be made therein without departing from the scope of the appended claims.

What is claimed is:

1. A printing device, comprising:

a platen having a bottom side, a print head facing side spaced from said bottom side, for facing a print head, and a detecting groove at its circumferential periphery outside a printing region of said platen;

first printing medium guiding means for guiding a printing medium along a first path extending along the bottom side of said platen to a position between said print head facing side and the print head, said first printing medium guiding means including a paper chuted beneath said bottom side defining a portion of said first path between said paper chute and said bottom side;

second printing medium guiding means for guiding a printing medium along a second path extending from beneath said printing device to said position between said print head facing side and the print head without passing along said portion of said first path, said second printing medium guiding means including a pair of paper guides defining therebetween a portion of said second path below said position between said print head facing side and the print head and spaced from said first path;

a first printing medium detecting lever having an end pivotable through a first slit in said paper chute between a first position in said detecting groove in said platen along said portion of said first path in response to the absence of a printing medium in said portion of said first path, and a second position spaced from said detecting groove in response to presence of the printing medium in said portion of said first path, said first lever being biased toward said first position;

a second printing medium detecting lever having an end pivotable through a second slit in said pair of paper guides between a third position in said portion of said second path in response to the absence of a printing medium in said portion of said second path, and a fourth position outward of said third position in response to the presence of the printing medium along said portion of said second path, said second lever being biased toward said third position, said first and second levers having means for pivoting said end of said first lever from said first postion to said second position when said second lever is pivoted from said third position to said fourth position; and sensor means for sensing when said end of said first lever is in said second position, thereby to sense when a printing medium is in one of said first and second paths.

2. A printing device as in claim 1, wherein said pivoting means include a cam slidably interconnecting said first and second levers.

3. A printing devie as in claim 1, wherein said first and second levers are biased by their weights respectively toward said first and third positions.

4. A printing device as in claim 1, further comprising a printer control circuit in said printer device, said sensor means comprising a sensor on a substrate of said printer control circuit.

5. A printing device as in claim 1, wherein said first and second levers are respectively pivotable about a first rotation support point and a second rotation support point, said second support point being spaced from said first lever and from said first rotation support point.

6. A printing device as in claim 1, wherein said paper chute extends horizontally along said bottom side of said plaen and said pair of paper guides extends generally vertically.

7. A printing device as in claim 1, wherein said first, second, third and fourth positions are located such that pivotal movement of said end of said first lever from said first position to said second position is in a first rotational direction relative to the axis of rotation of said first lever and pivotal movement from said third position to said fourth position of said end of said second lever relative to the axis of rotation of said second lever is in a second rotational direction opposite to said first rotational direction.

8. A printing device, comprising:

a platen having a bottom side, a print head facing side spaced from said bottom side, for facing a print head, and a detecting groove at its circumferential periphery outside a printing region of said platen;

first printing medium guiding means for guiding a first printing medium along a first path extending beneath said platen to a position between said print head facing side and the print head, said first printing medium guiding means including a paper chute beneath said bottom side defining a portion of said first path between said paper chute and said bottom side;

second printing medium guiding means for guiding a printing medium along a second path extending from beneath said printing device to said position between said print head facing side and the print head without passing along said portion of said first path, said second printing medium guiding means including a pair of paper guides defining therebetween said print head facing side and the print head and spaced from said first path;

a reciprocally pivotable integral printing medium detecting lever having a first end portion which moves reciprocally through a first slit in said paper chute into and out of said detecting groove with reciprocal pivotal movement of said lever, and having a second end portion which moves reciprocally through a second slit in said paper guides with reciprocal pivotal movement of said lever;

elastic means for elastically biasing said lever toward an equilibrium position, said first end portion of said lever being disposed in said first path and said second end portion of said lever being disposed in said second path, when said lever is in said intermediate position, such that said first end portion of said lever is pivoted out of said first path in response to the introduction of a printing medium into said portion of said first path so as to thereby pivot said lever away from said equilibrium position to a first displaced position, and said second end portion of said lever is pivoted out of said second path in response to the introduction of a printing medium into said portion of said second path so as to thereby pivot said lever away from said equilibrium position to a second displaced position; and sensor means for sensing when said lever is in one of said first and second displaced positions, thereby to sense when a printig medium is in one of said first and second paths.

9. A printing device as in claim 8, wherein said first and second displaced positions are located on opposite sides of said equilibrium position.

10. A printing device as in claim 9, wherein said elastic biasing means comprises a spring fixed at one end to a stationary portion of said printing device and at an opposite end to said lever.

* * * * *